US006575450B2

(12) United States Patent
Blackwell et al.

(10) Patent No.: US 6,575,450 B2
(45) Date of Patent: Jun. 10, 2003

(54) SINGULATION MECHANISM

(75) Inventors: Wayne Blackwell, Chenango Fork, NY (US); George C. Cera, Orlando, FL (US); Bruce Hanson, Endicott, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/772,821

(22) Filed: Jan. 30, 2001

(65) Prior Publication Data

US 2002/0101022 A1 Aug. 1, 2002

(51) Int. Cl.[7] ..... B65H 5/08

(52) U.S. Cl. ..... 271/11; 271/96; 271/98; 271/99; 271/104; 271/108; 271/10.03; 271/265.02

(58) Field of Search ..... 271/11, 12, 90, 271/94, 96, 98, 99, 104, 108, 10.03, 265.02

(56) References Cited

U.S. PATENT DOCUMENTS

| | | | | |
|---|---|---|---|---|
| 2,837,333 A | | 6/1958 | Sindzinski et al. | |
| 2,970,834 A | | 2/1961 | Martin et al. | |
| 3,194,552 A | | 7/1965 | Buchwald | |
| 3,279,786 A | * | 10/1966 | Fliegner et al. | 271/12 |
| 3,606,305 A | | 9/1971 | Debackere et al. | |
| 3,817,516 A | | 6/1974 | Lazzarotti et al. | |
| 3,941,372 A | * | 3/1976 | Matsuo | 271/96 |
| 4,357,007 A | | 11/1982 | Mens Franciscus et al. | |
| 4,401,301 A | * | 8/1983 | Hayskar | 271/96 |
| 4,421,306 A | | 12/1983 | Muka | |
| 4,440,492 A | * | 4/1984 | Howard | 271/275 |
| 4,523,753 A | | 6/1985 | Hiromori et al. | |
| 4,526,648 A | * | 7/1985 | Tochtermann | 271/94 |
| 4,632,381 A | | 12/1986 | Cuir et al. | |
| 4,651,984 A | | 3/1987 | Emrich | |
| 5,074,539 A | * | 12/1991 | Wells et al. | 271/12 |
| 5,133,543 A | * | 7/1992 | Eitel et al. | 271/96 |
| 5,139,253 A | | 8/1992 | Bohme et al. | |
| 5,226,547 A | | 7/1993 | Malatesta | |
| 5,290,022 A | | 3/1994 | Sabatier et al. | |
| 5,391,051 A | | 2/1995 | Sabatier et al. | |
| 5,398,922 A | | 3/1995 | Malatesta | |
| 5,450,939 A | | 9/1995 | Meyers et al. | |
| 5,507,480 A | | 4/1996 | Martin et al. | |
| 5,544,758 A | | 8/1996 | Malatesta | |
| 5,595,282 A | | 1/1997 | Mokler | |
| 5,697,606 A | | 12/1997 | Maass | |
| 5,704,607 A | | 1/1998 | Brotherston | |
| 5,881,860 A | | 3/1999 | Zecchi et al. | |
| 5,921,544 A | * | 7/1999 | Benedict | 271/265.02 |
| 5,951,007 A | | 9/1999 | Greive et al. | |
| 5,971,134 A | | 10/1999 | Trefz et al. | |
| 6,270,069 B1 | * | 8/2001 | Cera et al. | 271/104 |

FOREIGN PATENT DOCUMENTS

| | | | | |
|---|---|---|---|---|
| DE | 2905988 | * | 8/1979 | 271/12 |
| EP | 0018057 | | 10/1980 | |
| JP | 0256442 | * | 10/1989 | 271/90 |

* cited by examiner

*Primary Examiner*—H. Grant Skaggs
(74) *Attorney, Agent, or Firm*—Wolf, Greenfield & Sacks, P.C.

(57) ABSTRACT

An improved singulation mechanism is provided for flat articles having significant variations in size, thickness and weight, which mechanism utilizes at least two vacuum chambers positioned behind a moving perforated to feed the articles and selectively controls at least one of pressure and flow for at least one of the chambers to facilitate the feeding of heavier articles, while inhibiting bleed through doubles for lighter articles. A mechanism may be provided which provides a puff of air to at least one of the chambers at the end of the operation thereof to reduce the feeding of doubles and a bent fence may be suitably positioned to both facilitate feeding of shorter articles and to facilitate proper initial alignment of the articles.

31 Claims, 6 Drawing Sheets

SINGULATION MECHANISM

FIELD OF THE INVENTION

This invention relates to handling and processing systems for mixed mail and related articles, and more particularly to a singulation mechanism for use in such systems which facilitate the handling of articles having significant variation in size, thickness and weight.

BACKGROUND OF THE INVENTION

Mixed mail received at a post office or other location must be sorted and/or otherwise processed so as to be directable to a desired location. To accomplish this function, random items of incoming mail are typically stacked, either manually or otherwise, for feeding to a first mechanism which singulates the mail so that only a single piece of such mail, which is properly oriented and spaced, is passed on to the sorting or other processing mechanism of a mail handling system.

While many mechanisms currently on the market do an adequate job of singulating certain types of mail, increasing demands are being placed on such systems, both as to the ranges in size, thickness and weight of the mail pieces to be handled and as to the speed at which such systems are to operate, while still maintaining high controllability on the outputted mail pieces, a low jam rate, low damage rate and substantial elimination of doubles passing into the sorting mechanism. For example, a specification for mail pieces to be handled in such a high performance system might include pieces ranging in thickness from 0.007" to 1.25", pieces ranging in weight from 0.03 oz to 6.0 lbs., and pieces ranging in size from 3.5×"5.0" or 4.0×"4.0" to 15"×15". These variations in thickness, weight and size must be handled without sacrificing throughput, which may be up to approximately 14,500 mail pieces per hour, although this maximum rate may vary somewhat with the size of the pieces being processed, and preferably with an ability to control this rate. Further while the requirements discussed above are particularly applicable to mail handling systems, they can also arise in handling systems for packages and/or other generally flat articles.

A singulation mechanism designed to meet these specifications is taught in co-pending application Ser. No. 09/411,961, filed Oct. 4, 1999, entitled "Singulation Mechanism" and assigned to the assignee of this application. The subject matter of this co-pending application is incorporated herein by reference. The system of the prior application, which is shown in attached FIG. 1A, includes a singulation station 14 which receives a stack of mail or other appropriate flat articles 62, which articles contact a guide wall 32 on their leading edge side, and feeds such articles, one at a time, to a takeaway mechanism 16. Singulation station 14 includes a head against which articles 62 are pressed with a controlled pressure by mechanisms not shown in the Figure. The singulation head includes a selectively perforated belt 34 driven by rollers 50A–50E so as to pass in direction 38 over a pair of vacuum chambers V1, V2, chamber V1 being under a trailing side of each article 62, and chamber V2 being under a leading side of each article. A first sensor FL1 detects articles as they leave singulation station 14, and a second sensor FL2 senses articles as they reach a pinch roller mechanism 52 of takeaway mechanism 16.

In operation, vacuum chamber V1 is first operated, as shown in FIG. 1B, to pull a trailing side of the article 16 in contact with belt 34 against the portion of belt 34 over the V1 chamber. Since belt 34 has a very low friction surface, only the portion of the belt over the V1 chamber engages a leading article 62 of the stack and causes the article to move with belt 34 in direction 38. The distance between the leading edge of chamber V1 and sensor FL1 is such that the leading edge of even the smallest article 62 will reach FL1 before the trailing edge of the article is no longer over chamber V1. When the leading edge of the article is detected by sensor FL1, suitable controls are operative to turn off chamber V1 and to at the same time apply vacuum pressure to chamber V2. The turning off of vacuum pressure from chamber V1 prevents chamber V1 from feeding the next article in the stack, thus preventing the feeding of doubles, and the energization of chamber V2 causes belt 34 to engage the trailing portion of the article being fed and to advance this article to takeaway station 16. There is a slight deceleration of the article as chamber V1 stops driving it and chamber V2 is not fully operational. This deceleration, followed by a rapid acceleration as chamber V2 kicks in, tends to shake loose any double adhering to the article being fed. Again, the distance between the leading end of chamber V2 and sensor FL2/pinch roller 52 is less than the length of the shortest article being fed, this assuring that chamber V2 can feed all articles 62 to be fed to pinch roller 52 where they are detected by detector FL2. When the article reaches roller 52, its motion in direction 38 can be taken over by takeaway mechanism 16, and chamber V2 is therefore turned off as shown in FIG. 1B.

While the singulation mechanism of FIGS. 1A and 1B provides far superior performance in meeting the specifications indicated above than any prior singulation mechanism, in practice, the large variations in size, thickness and weight for the articles being fed has made it difficult to provide sufficient vacuum to feed heavier articles to be fed, for example articles weighing 4–6 pounds, while not having so much vacuum that it bleeds through thinner articles, resulting in doubles being fed. It has therefore been very difficult to select the vacuum pressures for both chambers so as to be able to feed all articles, and in particular all mail items, within the above specification without also causing the feeding of an unacceptably high number of doubles.

A second problem with the device shown in FIG. 1A has been that, once vacuum is removed from chamber V1. the chamber in practice does not quickly return to atmospheric pressure as shown in FIG. 1B. but continues to have some vacuum pressure even after chamber V2 has been activated. This extended vacuum pressure in chamber V1 can result in some lighter articles being pulled against belt 34 and held sufficiently so as to be fed by the belt while chamber V2 is clearing the leading article, this also resulting in the potential feeding of a double.

Another potential problem is that, in the system of FIG. 1A, operator skill is the only assurance that all articles 62 are aligned against wall or fence 32. This results in some articles not being properly aligned, leading to potential feeding errors. The system of FIG. 1A also has potential problems in feeding shorter articles.

A need therefore exists for an improved singulation mechanism which overcomes the problems indicated above, and which otherwise optimizes the singulation operation, particularly in high performance applications.

SUMMARY OF THE INVENTION

In accordance with the above, this invention provides a singulation head for use in a singulation mechanism for flat articles of varying size and weight, which mechanism includes a takeaway mechanism for articles exiting the head, detectors for selectively detecting article position for an article being singulated, and controls for the singulation mechanism. The singulation head includes a selectively perforated belt driven across the head at a selected rate, at least two vacuum chambers positioned behind the belt so as to apply vacuum thereto when energized, the chambers being successively positioned along the belt, with the controls energizing the chambers in a predetermined sequence in response to outputs from the detectors, and a feedback mechanism selectively controlling pressure and/or flow for at least one of the chambers to facilitate the feeding by the head to the takeaway mechanism of heavier articles to be singulated, while inhibiting bleedthrough doubles for lighter articles to be singulated.

The feed mechanism may include a metering plate between the chambers and the belt, the metering plate having openings therein over each chamber which permits sufficient pressure/flow to feed at least most of the articles with substantially no bleedthrough doubles. A mechanism may be provided for altering the metering plate for heavier articles to increase pressure/flow for at least one of the chambers sufficiently to feed such articles. The mechanism for altering may include second plate having larger openings formed therein over at least one of the chambers, the mechanism involving removing and replacing the metering plate, or the portion thereof over at least one of the chambers, using a second plate to cover or expose more or less of openings in the metering plate or other techniques.

The feed mechanism may include a portion of the controls operating in response to an indication from at least one of the detectors that an article has not been fed by the head for increasing the pressure and/or flow for at least one of the chambers to facilitate feeding of such article. For some embodiments, there is a chamber V1 adjacent a selected portion of each article at the beginning of a feed operation and a chamber V2 downstream from chamber V1, the portion of the controls increasing pressure and/or flow for at least chamber V1. For one embodiment, chamber V1 is divided into a chamber V1*a* and a chamber V1*b*, chamber V1*a* being between chambers V1*b* and V2. For this embodiment, chamber V1*a*, but not chamber V1*b*, is normally operated to feed articles, and a portion of the controls operates at least chamber V1*b* to facilitate feeding of an unfed article detected by said detectors. A portion of the controls may operate both chambers V1*a* and V1*b* at substantially the same time to feed the heavier article or may operate only chamber V1*b* for this purpose. Particularly in the latter situation, chamber V1*b* provides a greater pressure/flow than chamber V1*a*.

For various ones of the embodiments, a mechanism is included which provides a puff of air to a chamber, for example chamber V1*a* where there is such a chamber, or chamber V1, at the end of each operation thereof. The puff of air may be sufficient to momentarily positively pressurize the chamber to which it is applied. The puff of air may be controlled by a puffer valve, with the same signal preferably triggering both chamber V2 and the puffer valve.

The invention may also include a fence against which a leading edge of each article is to abut, one of the vacuum chambers, V2, being the leading-most one of the vacuum chambers, and the fence terminating at a distance from the belt slightly greater than the thickest article to be fed and at a point on the belt over a portion of chamber V2 between a mid-region thereof and a trailing edge thereof. A metering plate may be provided over chamber V2, the metering plate having openings formed therein over substantially only the portion of chamber V2 on the leading end side of the fence. The detectors may include a first detector located past a leading side of chamber V2, a second detector between the singulation head and the take-away mechanism and a third detector at the take-away mechanism. For some embodiments, the fence bends in the leading direction at a selected point behind the end thereof.

The invention also includes a singulation head for use in a singulation mechanism for flat articles of varying size and weight, which mechanism includes a takeaway mechanism for articles exiting the head, detectors for selectively detecting article position for articles being singulated and controls for the singulation mechanism, the singulation head including a selectively perforated belt driven across the head at a selected rate, at least two vacuum chambers positioned behind the belt so as to apply vacuum thereto when energized, the chambers being successively positioned along the belt, and the controls energizing the chambers in a predetermined sequence in response to outputs from the detectors, and a mechanism which provides a puff of air to at least one of the chambers at the end of each operation thereof. Such puff of air is preferably sufficient to momentarily positively pressurize the at least one chamber to which it is applied. As indicated above, the puff of air is preferably applied to chamber V1 or to chamber V1*a* where one of such chambers exists, and preferably controlled by a puffer valve triggered by the same trigger signal as chamber V2. The fence as described above may also be provided.

Finally, the invention may also include a singulation head for use in a singulation mechanism for flat articles of varying size and weight, which mechanism includes a take-away mechanism for articles exiting the head, detectors for selectively detecting article position for articles being singulated and controls for the singulation mechanism, the singulation head including a selectively perforated belt driven across the head at a selected rate. at least two vacuum chambers positioned behind the belt so as to apply vacuum thereto when energized, the chambers being successively positioned along the belt, and the controls energizing the chambers in a predetermined sequence in response to outputs from the detectors, and a fence against which a leading edge of each article is to abut, one of the vacuum chambers, V2, being the leading-most one of the vacuum chambers, the fence terminating at a distance from the belt slightly greater than a thickest article to be fed and at a point on the belt over a portion of chamber V2 between a mid-region thereof and a trailing end thereof. This aspect of the invention may include the metering plate over V2 having openings as described above, the three detectors described above and/or the fence bending in the leading direction at a selected point beyond the end thereof.

The foregoing and other objects, features and advantages of the invention will be apparent from the following more particular description of preferred embodiments of the invention as illustrated in the accompanying drawings, the same reference numerals being used for common elements in the various drawings.

IN THE DRAWINGS

DETAILED DESCRIPTION

Figure 1A:
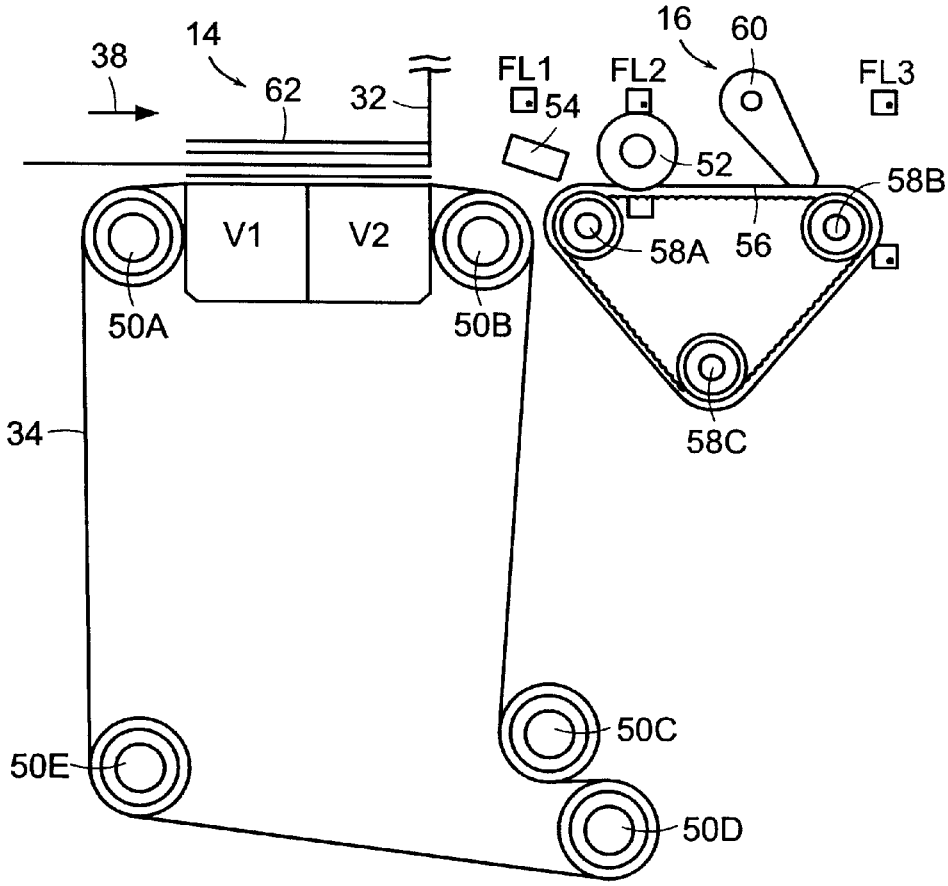
FIG. 1A PRIOR ART
FIG. 1A is a graphic top view representation of a prior art singulation head and takeaway mechanism.
Figure 1B:
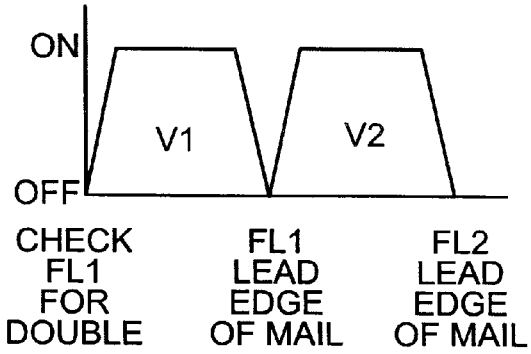
FIG. 1B PRIOR ART
FIG. 1B is a diagram illustrating a timing/distance profile for mail under the influence of vacuum chambers V1, V2 for the prior art singulation head shown in FIG. 1A.
Figure 2A:
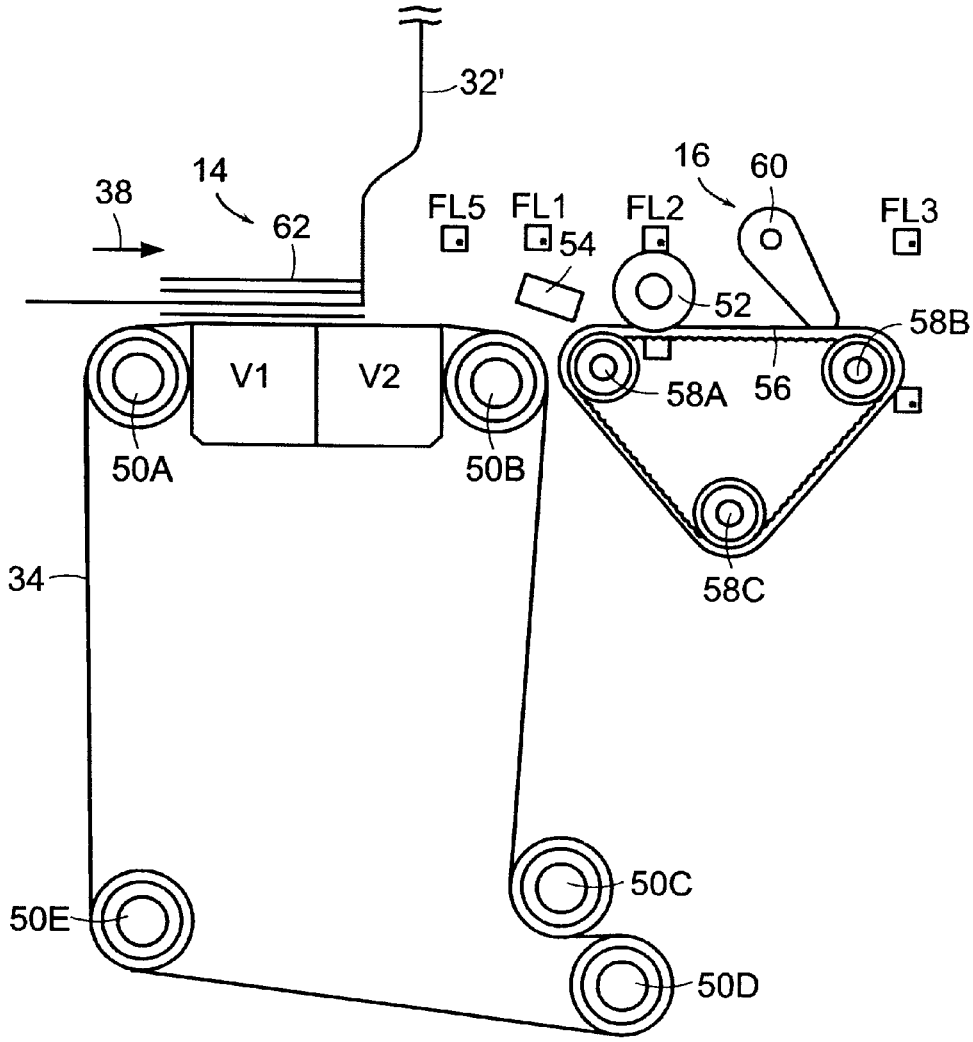
FIG. 2A is a graphic top view representation of an improved singulation head in accordance with at least one aspect of this invention and of the corresponding takeaway mechanism.
Figure 2B:
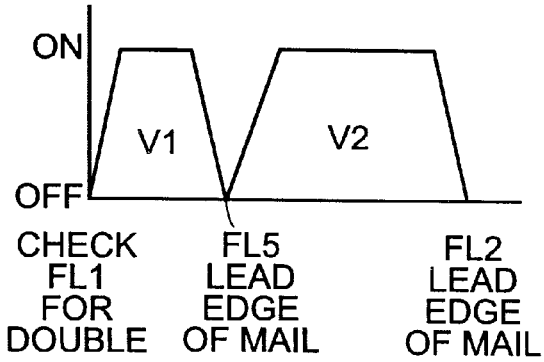
FIG. 2B is a diagram illustrating a timing/distance profile for mail for the head of FIG. 2A.
Figure 2C:
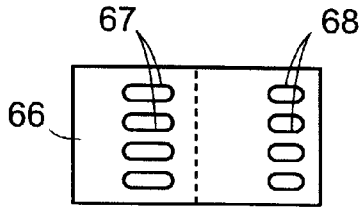
FIG. 2C is a front view of a meter or face plate for vacuum chambers V1, V2 of FIG. 2A.

FIG. 2A illustrates an embodiment of the invention which differs from the embodiment of FIG. 1A in that alignment wall 32 has been replaced by an alignment wall 32' which is further back on singulation head 14 and is bent from a position which is substantially the same as that for the wall 32 to the position shown when adjacent to the singulation head with the and of the wall spaced from the head by a distance slightly greater than the thickest article 62 to be fed and over a point near the middle of chamber V2. FIG. 2C shows a metering plate 66 which may be placed over vacuum chambers V1 and V2, with the openings 67 in the plate over vacuum chamber V1 being toward the leading side of this vacuum chamber and the openings 68 over the vacuum chamber V2 being located over the portion of chamber V2 which is on the forward or leading side of this vacuum chamber and is over the portion of the chamber beyond wall 32'. This embodiment of the invention also has an additional detector FL5 which is located at the leading edge side of chamber V2, and thus generates an output when the leading end of the article being fed is fully over openings 68. While for the embodiment shown in FIG. 2A, wall 32' is roughly half way or a little over half way back on chamber V2, depending on application, the wall may, for this embodiment of the invention, be positioned anywhere from over a mid-region of chamber V2 to the junction between the two chambers.

The embodiment of FIG. 2A offers at least two advantages. First, articles 62 are typically manually aligned against wall 32. While a skilled operator can normally do a good job of aligning the articles against this wall, inevitably, some articles, particularly smaller articles, will not be in registration against this wall. Smaller articles not being initially against the wall may prevent such articles from being properly fed and/or may result in vacuum also being applied to the article behind the forward most article, causing a double to be fed. The bent wall 32' moves articles 62 to in the rear or trailing direction as they advance to the singulation head, thus facilitating the alignment of all or substantially all of the articles against wall 32'.

Moving wall 32' back and providing an additional sensor FL5 also facilitates the feeding of smaller, shorter articles, assuring that these articles reach and are picked up by vacuum chamber V2 and fed by this chamber to take-away mechanism 16. Openings 68 being beyond wall 32' and vacuum chamber V1 being on for a shorter duration, as can be seen from FIG. 2B, also reduces bleed through of vacuum for such smaller articles, thereby reducing doubles generation.

Figure 3A:
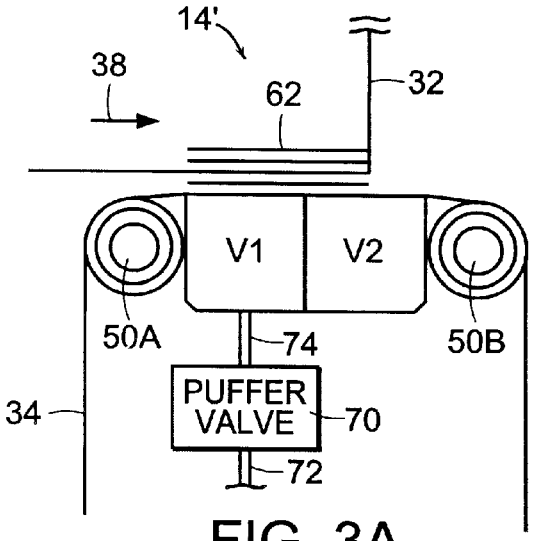
FIG. 3A is a graphic top view of the singulation head portion of the system shown in FIG. 2A as modified in accordance with one embodiment of the invention.
Figure 3B:
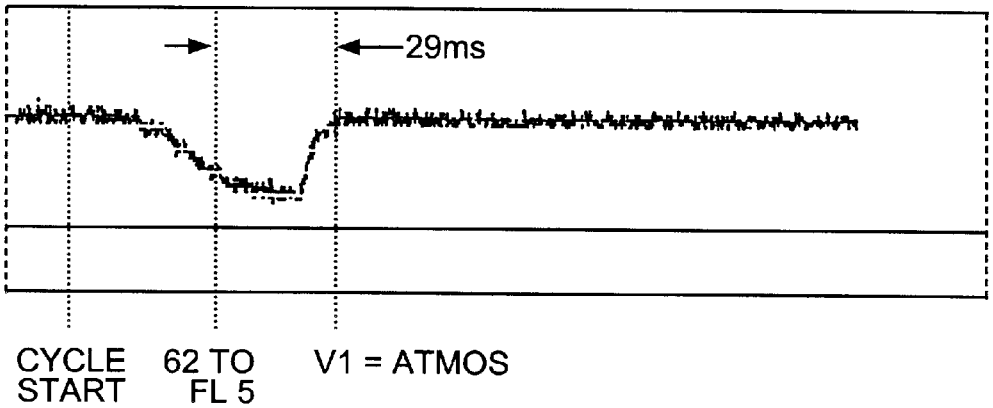
FIGS. 3B and 3C are diagrams illustrating the pressure profile for chamber V1 for the embodiments of FIG. 3A without use of a puffer valve and with use of the valve, respectively.
Figure 3C:
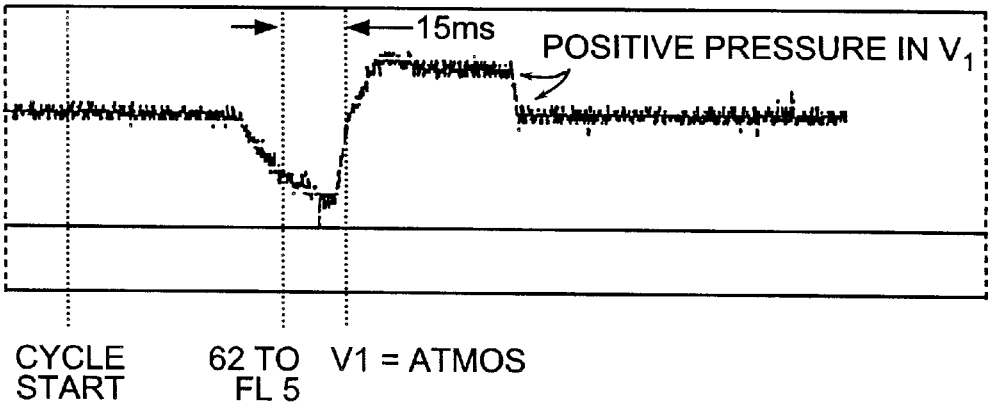

FIG. 3A illustrates an embodiment of the invention which may be used with either the embodiment of FIG. 1A or the embodiment of FIG. 2A, and FIGS. 4A–4C illustrate variations on this embodiment. In FIG. 3A, it is seen that the embodiment of FIGS. 1A, 2A has been modified by adding a puffer valve 70 which is connected between a line 72 leading to a positive pressure air source and a line 74 leading to the back of chamber V1. Referring to FIG. 3B, without puffer valve 70, there is a time delay between article 62 being detected by detector FL5 and the time vacuum pressure to chamber V1 is cut off and, once vacuum is cut off, there is a further significant time delay before the chamber returns to atmospheric pressure. For an illustrative embodiment, this time is 29 ms. Puffer valve 70 is enabled in response to the same output from FL5 which turns off vacuum to chamber V1 and turns on vacuum to chamber V2, and is enabled for the same time interval as chamber V2. As shown in FIG. 3C, while the pressure in chamber V1 initially goes negative, when the article being fed reaches sensor FL5, vacuum pressure to chamber V1 is cut off after some time delay and, at the same time, puffer valve 70 is activated causing a puff or burst of pressurized air to be applied to chamber V1. This reduces the time required for chamber V1 to return to atmospheric pressure, for example by about 50% to 15 ms for an illustrative embodiment. The duration of this puff is sufficient so that, as seen in FIG. 3C, chamber V1 becomes slightly positively pressurized for a duration until the article reaches FL2. The more rapid removal of vacuum pressure from chamber V1*a* s a result of the application of the air puff or burst thereto ensures that vacuum pressure is not applied to a trailing document, thus reducing the likelihood of a doubles being fed. To the extent some vacuum pressure had previously been applied to a trailing document to pull it against belt 34, the positive pressurization of the V1 chamber pushes the mail item or other article away from the belt, assuring that it does not move therewith, and further reducing the possibility of a doubles occurring, particularly for smaller articles. Puffer valve 70 thus eliminates one of the problems with the prior art system of FIG. 1A which has been discussed previously.

Referring to FIGS. 4A–4D. a first metering plate 78 is shown which may be screwed over the front of vacuum chambers V1 and V2. which plate has relatively large openings 80 and 82 formed therein over chambers V1 and V2. respectively. Since plate 78 permits substantial pressure and flow from the vacuum chambers to be applied to the openings in belt 34, and thus to the articles in contact therewith. Plate 78 is thus useful for feeding heavier articles. However, the flow with plate 78 can be sufficient that vacuum pressure bleeds through thinner articles being singulated by the head, permitting vacuum to be applied to the article in the stack behind the article being fed. If this second article is also a relatively small and light article which can be fed by the vacuum pressure applied thereto, this can result in a double being fed. Therefore, it is preferable when lighter and thinner documents are being fed that metering plate 84 be screwed to the face of chambers V1 and V2, this plate having relatively small openings 86 over the leading end of the V1 chamber and larger openings 88 over the leading edge of chamber V2; however, the openings 88 are still substantially smaller than the openings 82 of plate 78. The smaller openings of plate 84 restrict air flow, and thus restrict the vacuum applied to the article 62 adjacent belt 34. The combination of the applied pressure and the openings 86 and 88 are selected to provide sufficient flow so that the head can feed most articles 62 which it is designed to feed; however, the flow through plate 84 is not sufficient to feed heavier articles. This means that an operator of the machine in which a head having plate 84 is being utilized must presort the mail or other articles to eliminate the heavier articles therefrom when head 84 is in place and must periodically unscrew and replace metering plate 84 with, for example, metering plate 78 to do one or more runs of the heavier articles.

Figure 4A:
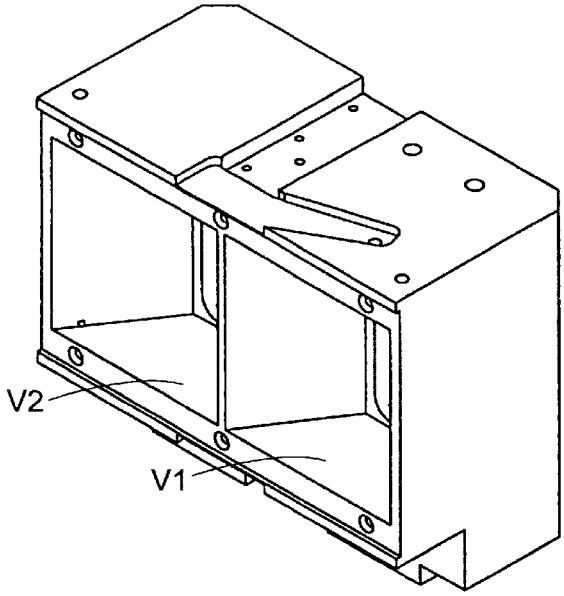
FIG. 4A is a front perspective view of a pair of vacuum chambers suitable for use in practicing the embodiment of FIG. 2A.
Figure 4B:
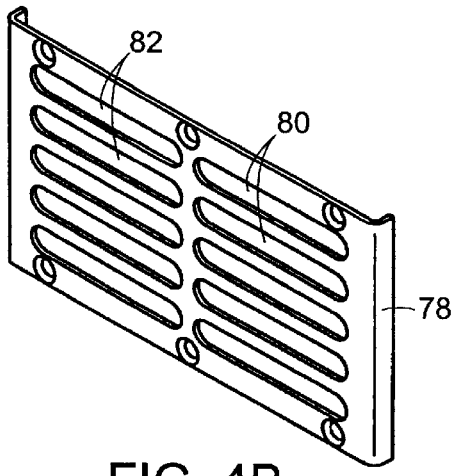
FIG. 4B is a front perspective view of a meter plate which may be placed over the front of the vacuum chambers of FIG. 4A, particularly to move heavy articles.
Figure 4C:
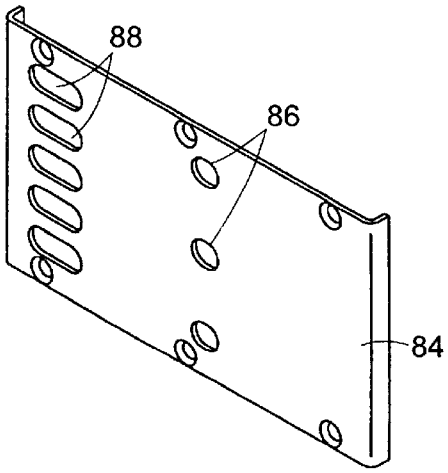
FIG. 4C is a front perspective view of a meter plate which may be placed over the vacuum chambers of FIG. 4A to move lighter articles.
Figure 4D:
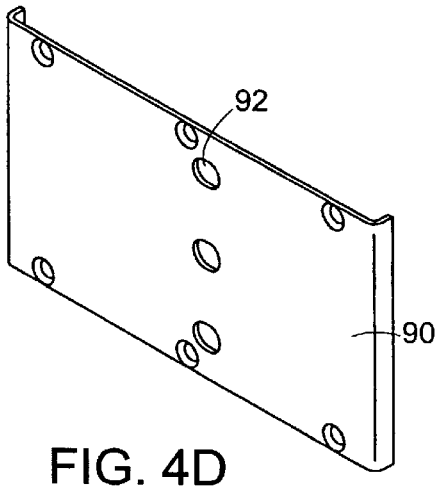
FIG. 4D is a front perspective view of a plate which may be slid over the meter plate of FIG. 4B when lighter articles are to be fed and selectively removed for the feeding of heavier articles.

While the entire plate 78, 84 is replaced for the embodiment shown in FIGS. 4A–4C, this is not a limitation on the invention, and it may, for example, be necessary only to replace the rear portion of the metering plate over chamber V1 rather than the entire plate in order to feed heavier articles. Further, to speed up the exchange operation, rather than screwing the metering plates 78, 84 to the face of the vacuum chambers, it may be possible to snap or slide the plates into position to facilitate the exchanging thereof. Further, rather than fully replacing plate 78, it may be possible to slide a plate 90 or pivot a plate 90 in place over plate 78 so that, for example, plate 90 covers half or two-thirds of the openings 82 to leave effective openings of the general size of openings 88 and openings 80 are covered to permit flow only through the much smaller openings 92. With such an arrangement, it might be possible for plate 90, for example, to normally be in place, permitting perhaps 80 percent or more of articles to be fed, and for plate 90 to be slid out of the way, wholly or partially, either by the operator or under automatic control, when the head is unable to feed an article applied thereto.

While the techniques described above overcome the problem of being able to feed both relatively heavy articles and relatively light and thin articles with the same system without an unacceptably high level of doubles, it can also result in a significant reduction in the throughput of the system and, for at least some of the techniques indicated above, requires greater operator involvement, which can further reduce throughput and/or increase costs of operation. Operating in this way is therefore not preferred, particularly in applications where a significant number of heavier articles are likely to be encountered.

Figure 5:
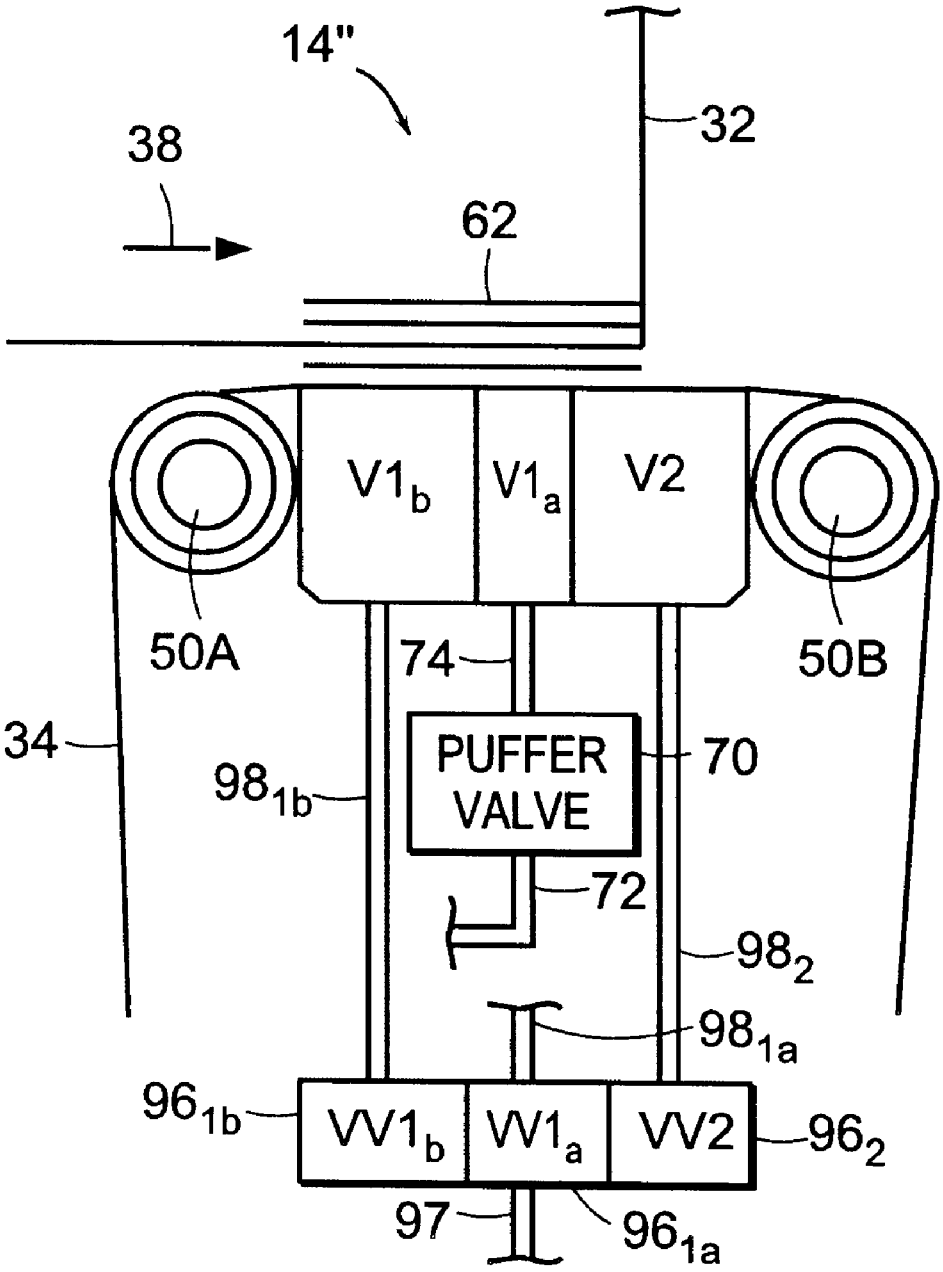
FIG. 5 is a graphic top view representation of the singulation portion of the mechanism of FIG. 2A for an alternative embodiment of the invention.
Figure 6A:
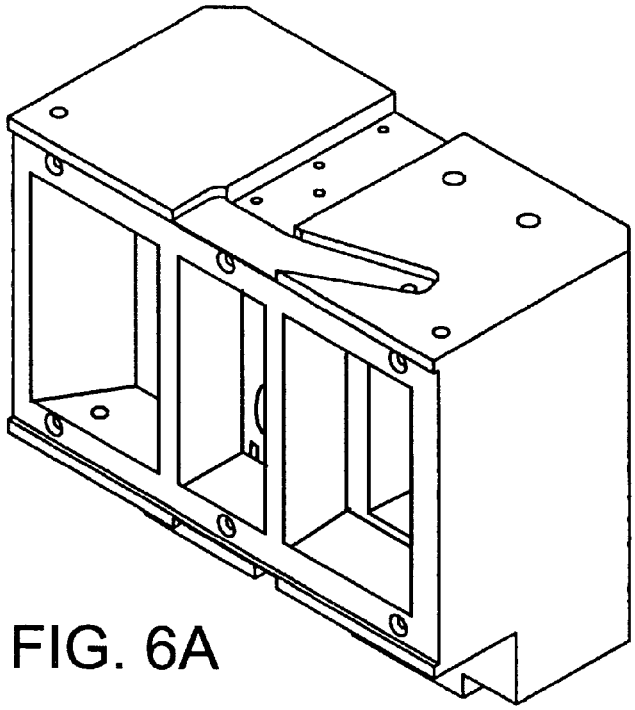
FIGS. 6A and FIG. 6B are front perspective views of the vacuum chamber head of FIG. 5 with the metering plate removed and with an illustrative metering plate in place, respectively.
Figure 6B:
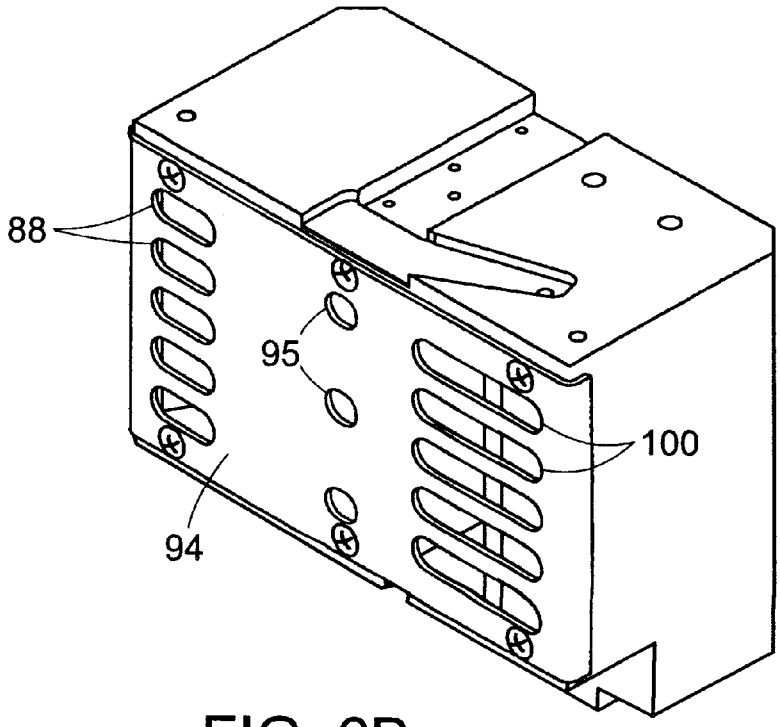

FIG. 5 shows an alternative embodiment of the invention which facilitates automatic operation, thus permitting a wider range of article weights to be handled without an increase in the instance of doubles, and without a significant reduction in throughput. For this embodiment of the invention, instead of having two vacuum chambers V1 and V2, three vacuum chambers V1*a*, V1*b* and V2 are provided, with chamber V1*a* being between chambers V1*b* and V2 and with chamber V1*a* being smaller, and therefore providing less flow, than the other two chambers. As shown in FIG. 6B, the holes 95 in metering plate 94 over the vacuum chambers are also relatively small for chamber V1*a*, further reducing flow for this chamber. Puffer valve 70 is provided for chamber V1*a*. Each of the vacuum chambers is connected to a vacuum line 97 through a corresponding vacuum valve $\mathbf{96}_{1a}$–$\mathbf{96}_2$ and a corresponding vacuum line $\mathbf{98}_{1a}$–$\mathbf{98}_2$ to the corresponding vacuum chamber. Vacuum valves 96 are individually controlled from a suitable processor. Metering plate 94 has openings 100 in front of vacuum chamber V1*b* which are slightly smaller than the openings 80 in metering plate 78 and has openings 88 in front of vacuum chamber V2 which are substantially the same as openings 88 in metering plate 84.

In operation, vacuum pressure followed by air pressure from puffer valve 70 is normally applied to valve V1*a* , the pressure profile for this vacuum chamber being substantially the same as that for chamber V1 in FIG. 3C. At the same time that puffer valve 70 is operated, valve $\mathbf{96}_{1a}$ is closed and valve $\mathbf{96}_2$ is opened, causing vacuum to be applied to chamber V2 to complete the feeding of the article. With the arrangement shown in FIGS. 5 and 6, and with valves V1*a* and V2 being operated as indicated, sufficient flow should be applied to feed most of a normal mixed mail input, perhaps 80% or more depending on the mix. When a heavier article is received at head 14", for which activation as shown of chambers V1*a* and V2 does not provide sufficient pressure and flow to feed, at the end of a selected maximum time period for activation of chamber V1*a*, sensor FL5 will indicate that the leading edge of the article has not advanced to this point. When this occurs, chamber V1*b* is activated, either alone or in conjunction with chamber V1*a*. Because of the larger size and capacity of chamber V1*b* and the larger openings 100 in metering plate 94 in front of chamber V1*b*, chamber V1*b* provides sufficient flow to move the heaviest article which the system is designed to handle, particularly when operated in conjunction with chamber V1*a*. When the article has advanced to FL1, chamber V1*b* (and V1*a* if still operated) is cut off and chamber V2 energized to move the article to takeaway mechanism 16 in the manner previously described. While chamber V1*a* could be operated in conjunction with chamber V1*b*, the added flow provided by chamber V1*a* may not be required for some applications. Further., while a puffer valve could be provided for chamber V1*b*, since this chamber is operated only for larger heavier articles, any residual vacuum in this chamber is normally not a problem. However, in a truly mixed mail environment, where the mail item following a heavy item may be a small thin item, a puffer valve for chamber V1*b*, while generally not required, may be included. Once the heavy article has been fed, the system returns to operating only with chambers V1*a* and V2 for the feeding of subsequent articles until the singulation mechanism 14" is again unable to feed the article pressed against belt 34.

A system has thus been provided which permits optimum flow to be provided for each article being fed so that all articles within a relatively wide size and weight range may be successfully fed by the head, while maintaining the level of doubles passing from singulation head 14–14" at an acceptably low level. While the invention has been particularly shown and described above with reference to several illustrative embodiments, and variations on these embodiments have been discussed, it is apparent that these various embodiments and modifications are being presented for purposes of illustration only and that further modifications may be made in the invention by one skilled in the art while still remaining within the spirit and scope of the invention, which is to be defined only by the appended claims.

What is claimed is:

1. A singulation head for use in a singulation mechanism for flat articles of varying size and weight, which mechanism includes a takeaway mechanism for articles exiting the head, detectors for selectively detecting article position for an article being singulated and the singulation head including:

a selectively perforated belt driven across said head at a selected rate, at least three vacuum chambers positioned behind said belt so as to apply vacuum thereto when energized, said chambers being successively positioned along said belt; wherein a first of the at least three vacuum chambers begins extraction of an article by applying a substantially light vacuum pressure thereto; a second of the at least three vacuum chambers continues extraction of the article in a controlled manner for presentation to downstream devices and, after detection of a successfully captured double, begins extraction of an article in that double; and a third of the at least three vacuum chambers provides additional necessary vacuum pressure to move heaviest of articles upon failure by the first chamber to move the heaviest of articles; and a feed mechanism selectively controlling at least one of pressure and flow for at least one of said chambers to facilitate the feeding by said head to said takeaway mechanism of heavier articles to be singulated while inhibiting bleed through doubles for lighter articles to be singulated.

2. A singulation head as claimed in claim 1 wherein said feed mechanism includes a metering plate between said chambers and said belt, said metering plate having openings therein over each chamber which permit sufficient pressure/flow to feed at least most said articles with substantially no bleed through doubles.

3. A singulation head as claimed in claim 2 wherein pressure/flow for at least one of said chambers is increased sufficiently to feed heavier articles.

4. A singulation head as claimed in claim 3 wherein said mechanism for altering includes a second plate having larger openings formed therein over at least one of said chambers, the openings of the second plate being interchangeable with the corresponding openings of said metering plate.

5. A singulation head for use in a singulation mechanism for flat articles of varying size and weight, which mechanism includes a takeaway mechanism for articles exiting the head, detectors for selectively detecting article position for an article being singulated and the singulation head including:

a selectively perforated belt driven across said head at a selected rate, at least two vacuum chambers positioned behind said belt so as to apply vacuum thereto when energized, said chambers being successively positioned along said belt; and a feed mechanism selectively controlling at least one of pressure and flow for at least one of said chambers to facilitate the feeding by said head to said takeaway mechanism of heavier articles to be singulated while inhibiting bleed through doubles for lighter articles to be singulated, wherein the feed mechanism operates in response to an indication from at least one of said detectors that an article has not been fed by said head for increasing at least one of the pressure/flow for at least one of said chambers to facilitate feeding of said article, wherein there is a chamber V1 adjacent a selected portion of each article at the beginning of a feed operation, and a chamber V2 downstream from chamber V1, and wherein said feed mechanism increases pressure/flow for at least V1 and wherein chamber V1 is divided into a chamber V1*a* and a chamber V1*b*, chamber V1*a* being between chambers V1*b* and V2, wherein chamber V1*a*, but not chamber V1*b*, is normally operated to feed articles, and wherein feed mechanism operates at least chamber V1*b* to facilitate feeding of said article.

6. A singulation head as claimed in claim 5 wherein said feed mechanism operates both chambers V1*a* and V1*b* at substantially the same time.

7. A singulation head as claimed in claim 5 wherein chamber V1*b* provides greater pressure/flow than chamber V1*a*.

8. A singulation head as claimed in claim 7 including a mechanism which provides a puff of air to chamber V1*a* at the end of each operation thereof.

9. A singulation head as claimed in claim 8, wherein said puff of air is sufficient to momentarily positively pressurize chamber V1*a*.

10. A singulation head as claimed in claim 8 wherein said puff of air is controlled from a puffer valve, and wherein a same signal triggers both chamber V2 and the puffer valve.

11. A singulation head as claimed in claim 5 including a mechanism which provides a puff of air to chamber V1 at the end of each operation thereof.

12. A singulation head as claimed in claim 11 wherein said puff of air is sufficient to momentarily positively pressurize chamber V1.

13. A singulation head for use in a singulation mechanism for flat articles of varying size and weight, which mechanism includes a takeaway mechanism for articles exiting the head, detectors for selectively detecting article position for an article being singulated and the singulation head including:

a selectively perforated belt driven across said head at a selected rate, at least two vacuum chambers positioned behind said belt so as to apply vacuum thereto when energized, said chambers being successively positioned along said belt; and a feed mechanism selectively controlling at least one of pressure and flow for at least one of said chambers to facilitate the feeding by said head to said takeaway mechanism of heavier articles to be singulated while inhibiting bleed through doubles for lighter articles to be singulated, further including a fence against which a leading edge of each article is to abut, one of said vacuum chambers, V2, being the leading-most one of said vacuum chambers, said fence terminating at a distance from said belt slightly greater than a thickest article to be fed and at a point on the belt over a portion of chamber V2 between a mid-region thereof and a trailing end thereof.

14. A singulation head as claimed in claim 13, including a metering plate over chamber V2, said metering plate having openings formed therein over substantially only the portion of chamber V2 on the leading end side of said fence.

15. A singulation head as claimed in claim 13 wherein said detectors include a first detector located past a leading side of chamber V2, a second detector between said singulation head and said take-away mechanism, and a third detector at said take-away mechanism.

16. A singulation head as claimed in claim 13 wherein said fence bends in the leading direction at a selected point behind an end thereof.

17. A singulation head for use in a singulation mechanism for flat articles of varying size and weight, which mechanism includes a takeaway mechanism for articles exiting the head, detectors for selectively detecting article position for articles being singulated and the singulation head including:

a selectively perforated belt driven across said head at a selected rate;

at least two vacuum chambers positioned behind said belt so as to apply vacuum thereto when energized, said chambers being successively positioned along said belt and a mechanism which provides a puff of air to at least one of said chambers at the end of each operation thereof.

18. A singulation head as claimed in claim 17 wherein said puff of air is sufficient to momentarily positively pressurize said at least one chamber.

19. A singulation head as claimed in claim 17 wherein there is a chamber V1 adjacent a selected portion of each article at the beginning of a feed operation, and a chamber V2 downstream from chamber V1, and wherein said mechanism provides a puff of air to at least chamber V1.

20. A singulation head as claimed in claim 19 wherein V1 is divided into a chamber V1*a* and a chamber V1*b*, chamber V1*a* being between chambers V1*b* and V2, wherein chamber V1*a*, but not chamber V1*b*, is normally operated to feed articles, and wherein said mechanism provides a puff of air to at least chamber V1*a*.

21. A singulation head as claimed in claim 20 wherein said puff of air is sufficient to momentarily positively pressurize chamber V1*a*.

22. A singulation head as claimed in claim 21 wherein said puff of air is controlled from a puffer valve, and wherein a same signal triggers both chamber V2 and the puffer valve.

23. A singulation head as claimed in claim 19 wherein said puff of air is sufficient to momentarily positively pressurize chamber V1.

24. A singulation head as claimed in claim 17 including a fence against which a leading edge of each article is to abut, one of said vacuum chambers, V2, being the leading-most one of said vacuum chambers, said fence terminating at a distance from said belt slightly greater than a thickest article to be fed and at a point on the belt over a portion of chamber V2 between a mid-region thereof and a trailing end thereof.

25. A singulation head as claimed in claim 24 including a metering plate over chamber V2, said metering plate having openings formed therein over substantially only the portion of chamber V2 on the leading end side of said fence.

26. A singulation head as claimed in claim 24 wherein said detectors include a first detector located past a leading side of chamber V2, a second detector between said singulation head and said take-away mechanism, and a third detector at said take-away mechanism.

27. A singulation head as claimed in claim 24 wherein said fence bends in the leading direction at a selected point behind the end thereof.

28. A singulation head for use in a singulation mechanism for flat articles of varying size and weight, which mechanism includes a takeaway mechanism for articles exiting the head, detectors for selectively detecting article position for articles being singulated and the singulation head including:

a selectively perforated belt driven across said head at a selected rate;

at least two vacuum chambers positioned behind said belt so as to apply vacuum thereto when energized, said chambers being successively positioned along said belt and a fence against which a leading edge of each article is to abut, one of said vacuum chambers, V2, being the leading-most one of said vacuum chambers, said fence terminating at a distance from said belt slightly greater than a thickest article to be fed and at a point on the belt over a portion of chamber V2 between a mid-region thereof and a trailing end thereof.

29. A singulation head as claimed in claim 28 including a metering plate over chamber V2, said metering plate having openings formed therein over substantially only the portion of chamber V2 on the leading end side of said fence.

30. A singulation head as claimed in claim 28 wherein said detectors include a first detector located past a leading side of chamber V2, a second detector between said singulation head and said take-away mechanism, and a third detector at said take-away mechanism.

31. A singulation head as claimed in claim 28 wherein said fence bends in the leading direction at a selected point behind the end thereof.

* * * * *